US007410523B2

(12) United States Patent
Nakamura et al.

(10) Patent No.: US 7,410,523 B2
(45) Date of Patent: Aug. 12, 2008

(54) FOAMING AGENT FOR MANUFACTURING A FOAMED OR POROUS METAL

(75) Inventors: Takashi Nakamura, Miyagi (JP); Ryoichi Ishikawa, Saitama (JP); Katsuhiro Shibata, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/393,865

(22) Filed: Mar. 31, 2006

(65) Prior Publication Data

US 2006/0173082 A1 Aug. 3, 2006

Related U.S. Application Data

(62) Division of application No. 10/698,015, filed on Oct. 31, 2003, now abandoned.

(30) Foreign Application Priority Data

Nov. 19, 2002 (JP) ..... 2002-335622

(51) Int. Cl.
*C22B 21/06* (2006.01)

(52) U.S. Cl. ..... 75/300

(58) Field of Classification Search ..... 75/415, 75/403, 300
See application file for complete search history.

(56) References Cited

U.S. PATENT DOCUMENTS

| | | | | |
|---|---|---|---|---|
| 3,297,431 | A * | 1/1967 | Ridgway, Jr. | 75/415 |
| 4,187,210 | A | 2/1980 | Howard, Jr. | |
| 4,681,626 | A * | 7/1987 | Fujishige et al. | 75/674 |
| 4,861,370 | A | 8/1989 | Reeve-Parker | |
| 5,151,246 | A | 9/1992 | Baumeister et al. | |
| 5,401,568 | A | 3/1995 | Hähn et al. | |
| 6,136,085 | A | 10/2000 | Adams, Jr. et al. | |
| 2001/0025549 | A1 * | 10/2001 | Tanigaki et al. | 75/476 |

FOREIGN PATENT DOCUMENTS

| | | | |
|---|---|---|---|
| EP | 0 431 772 | A1 * | 11/1990 |
| JP | 58-100935 | | 6/1983 |
| JP | 2898437 | | 3/1999 |
| RU | 2068455 | C1 * | 10/1996 |
| WO | WO 91/01387 | * | 2/1991 |

OTHER PUBLICATIONS

PBK Engineering Ltd., "Lodestone Iron Ore Project, Preliminary Evaluation", Jan. 1992 (p. 5-7).*

Eisele et al. "A Review of Binders in Iron Ore Pelletization", Mineral Processing & Extractive Metall. Rev., 24: 1-90, 2003 (p. 34).*

Kawatra et al., "Final Technical Report, Sep. 1, 1995—Aug. 31, 1996)", http://www.icci.org/96final/kawatra.htm, printed from internet Dec. 19, 2006, report datefrom internt archive Oct. 7, 1999.*

(Continued)

*Primary Examiner*—Roy King
*Assistant Examiner*—Tima M McGuthry-Banks
(74) *Attorney, Agent, or Firm*—Arent Fox LLP

(57) ABSTRACT

A foaming agent used for manufacturing a foamed or porous metal. The agent is composed of a foamable powder and a coating layer of $SiO_2$ covering the particle surfaces of the powder and having a good wetting property therewith.

12 Claims, 6 Drawing Sheets

OTHER PUBLICATIONS http://www.lovson.com/bentonite.html, printed from internet Dec. 19, 2006.*

Webster's Third New International Dictionary, 1981, p. 279.*

Direct Reduced Iron, Technology and Economics of Production and Use, 1980, p. 212.*

United States Steel, "The Making, Shaping, and Treating of Steel", 10th edition, 1985, Association of Iron and Steel Engineers, 325-326.*

Tarasevich et al, Colloid Journal, vol. 63, No. 2, 2001. pp. 224-228.*

Derwent abstract of RU 2068455 C1, published Oct. 27, 1996. Acc. No. 1997-279518.*

JPO on East, Patent Abstracts of Japan, Japan Patent Office JP358100935A, Jun. 15, 1983.

* cited by examiner

| | FOAMING AGENT |
|---|---|
| EXAMPLE | $SiO_2$ + $CaCO_3$ COATING |
| COMP. EX.1 | $CaCO_3$ ALONE |
| COMP. EX.2 | $TiH_2$ |

FOAMING AGENT FOR MANUFACTURING A FOAMED OR POROUS METAL

CROSS-REFERENCE TO RELATED APPLICATION

This is a Divisional Application which claims the benefit of U.S. patent application Ser. No. 10/698,015, filed Oct. 31, 2003, now abandoned, which claims priority to Japanese Patent Application No. 2002-335622 filed on Nov. 19, 2002. The disclosures of the prior applications are hereby incorporated herein in their entirety by reference.

FIELD OF THE INVENTION

The present invention relates to a foaming agent used for manufacturing a foamed or porous metal (or alloy).

BACKGROUND OF THE INVENTION

There is known a method of manufacturing a foamed or porous metal by adding a foaming agent to a molten or powdered metal and gasifying the foaming agent under heat or otherwise to form numerous pores in the metal (see, for example, Japanese Patent No. 2,898,437). In the narrow senses of the words, a foamed metal containing gas in its pores differs from one not containing such gas, but since they are equal in having numerous pores, they are herein referred to together as a foamed or porous metal.

Japanese Patent No. 2,898,437 gives 0.2% by weight of titanium hydride and sodium hydrogen carbonate as specific examples of a foaming agent. The use of titanium hydride or sodium hydrogen carbonate having a high reducing power is usual for foaming aluminum having a high affinity for oxygen. Titanium hydride and sodium hydrogen carbonate, however, have the draw-back that they are expensive and raise the cost of manufacturing a foamed or porous metal. Moreover, they produce hydrogen gas which is so explosive as to call for the utmost care in handling and thereby impose a heavy burden on the workers. Thus, there is a serious demand for a foaming agent which can be used at a low cost without producing any danger of hydrogen explosion when manufacturing a foamed or porous metal.

SUMMARY OF THE INVENTION

According to this invention, there is provided a foaming agent used for manufacturing a foamed or porous metal and comprising a foamable powder and a coating layer of $SiO_2$ covering the particle surfaces of the powder.

As $SiO_2$ has a good wetting property with molten aluminum, a foaming agent obtained by coating a foamable powder with a layer of $SiO_2$ can be distributed well in molten metal and thereby produce a foamed or porous metal of good quality having uniformly distributed pores.

The foaming agent obtained simply by coating a foamable powder with $SiO_2$ is inexpensive, and is free from any danger of hydrogen explosion, since the foamable powder does not contain any hydrogen radical. The foamable powder is preferably of a carbonate, such as calcium carbonate ($CaCO_3$) or magnesium carbonate ($MgCO_3$), as it produces carbon dioxide having no danger of explosion. Moreover, magnesium carbonate ($MgCO_3$) is preferred, since it is easily available and can be produced by the dehydration, etc. of highly stable basic magnesium carbonate ($4\ MgCO_3.Mg(OH_2).5H_2O$).

BRIEF DESCRIPTION OF THE DRAWINGS

A preferred embodiment of the present invention will be described in detail below, by way of example only, with reference to the accompanying drawings, in which.

DETAILED DESCRIPTION OF THE PREFERRED EMBODIMENT

We, the inventors of this invention, first tried to reevaluate sodium carbonate as an inexpensive foaming agent not containing hydrogen. More specifically, we tried to manufacture a foamed metal by mixing a powder of sodium carbonate with molten aluminum. We cut a section from the foamed metal and examined it through a microscope. We found that the pores were undesirably large and in a small number per unit volume, as we had feared. We thought that the large pores had been formed by the combination of bubbles formed in the molten metal, and that as sodium carbonate had not uniformly been dispersed in molten aluminum because of its very low wetting property, its decomposition had formed a large amount of locally concentrated bubbles resulting in their mutual bombardment and growth into large pores.

Accordingly, we have reached the conclusion that the use of a substance having a good wetting property with molten aluminum as a new foaming agent will make it possible to restrain the combination of bubbles because of its uniform dispersion. In search for a material having a better wetting property with molten aluminum, we have found $SiO_2$ as a material which is easily available at a very low cost.

Figure 1:
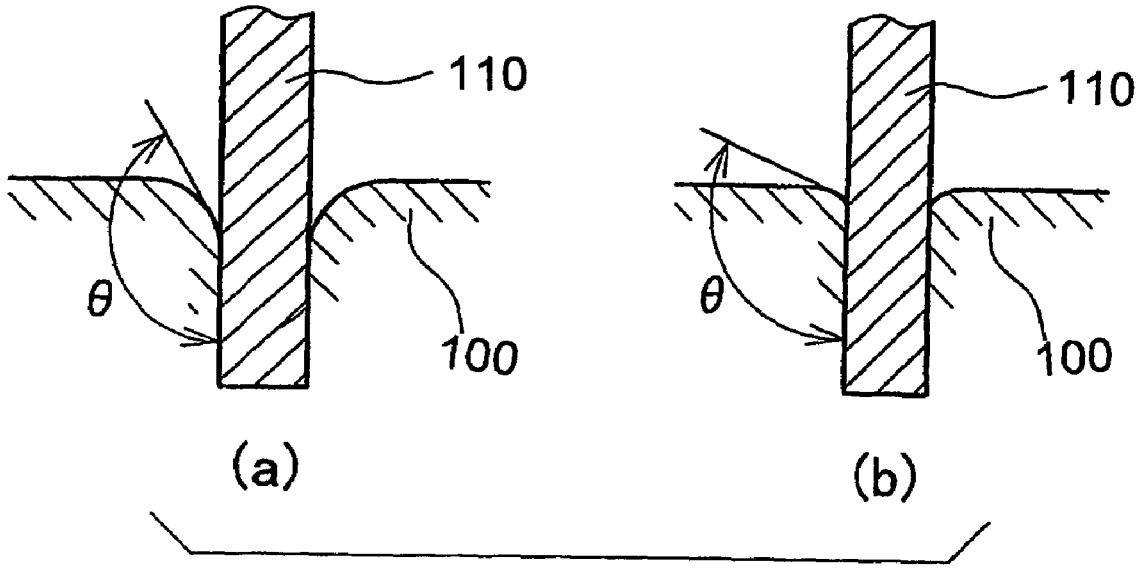
FIGS. 1(*a*) and (*b*) are each a diagram explaining a contact angle.

As shown in FIGS. 1(*a*) and (*b*), a test specimen 110 is vertically supported and lowered softly into a mass of molten metal 100 with the result that a depression is formed in the molten metal surface, with an angle θ left between an edge of the depression and the vertical line. Such an angle θ is called a contact angle and examined to determine the wetting property of a material with a molten metal.

In FIG. 1(*a*), a test specimen 110 of a low wetting property with molten metal 100 is lowered into a mass of the molten metal. The contact angle θ is relatively large as the test specimen has a low wetting property with the molten metal. In contrast, in FIG. 1(*b*), a test specimen 110 of a high wetting property with molten metal 100 is lowered into a mass of the molten metal. The contact angle θ is relatively small as the test specimen has a high wetting property with molten metal. Thus, the wetting property of a certain material with molten metal can be determined from its contact angle θ.

Figure 2:
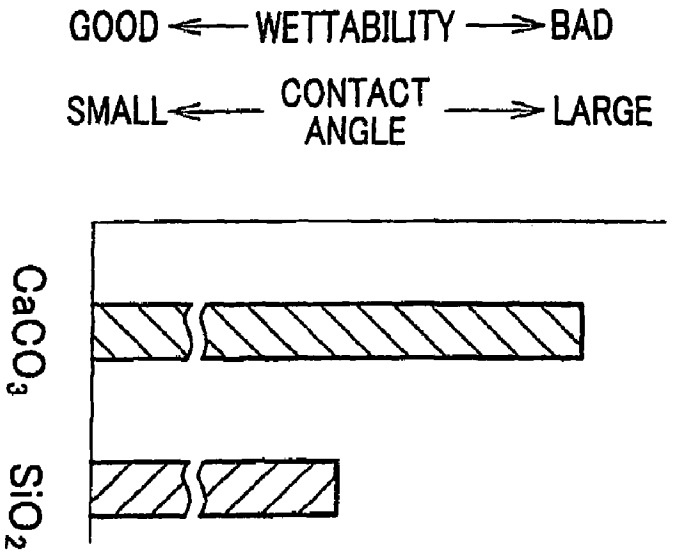
FIG. 2 is a graph showing the contact angle and wetting property of different materials.

Reference is now made to the graph of FIG. 2, showing the contact angle and wetting property of two different materials as determined by the method described with reference to FIGS. 1(*a*) and (*b*). The test specimens 110 were of $CaCO_3$ and $SiO_2$, respectively, and their contact angles were examined by employing molten aluminum as molten metal 100. We have found $CaCO_3$ with a large contact angle and $SiO_2$ with a small contact angle. This has confirmed that $SiO_2$ has a satisfactorily good wetting property with molten aluminum as compared with $CaCO_3$. We have, therefore, considered that the coating of a powder of $CaCO_3$ with $SiO_2$ will make it possible to prevent the movement of bubbles and thereby the mutual bombardment and combination of bubbles during the initial stage of foaming by virtue of the action of $SiO_2$ having a good wetting property. We have tried to manufacture a foamed metal by doing so and obtained good results, as will be described in detail later.

Figure 3:
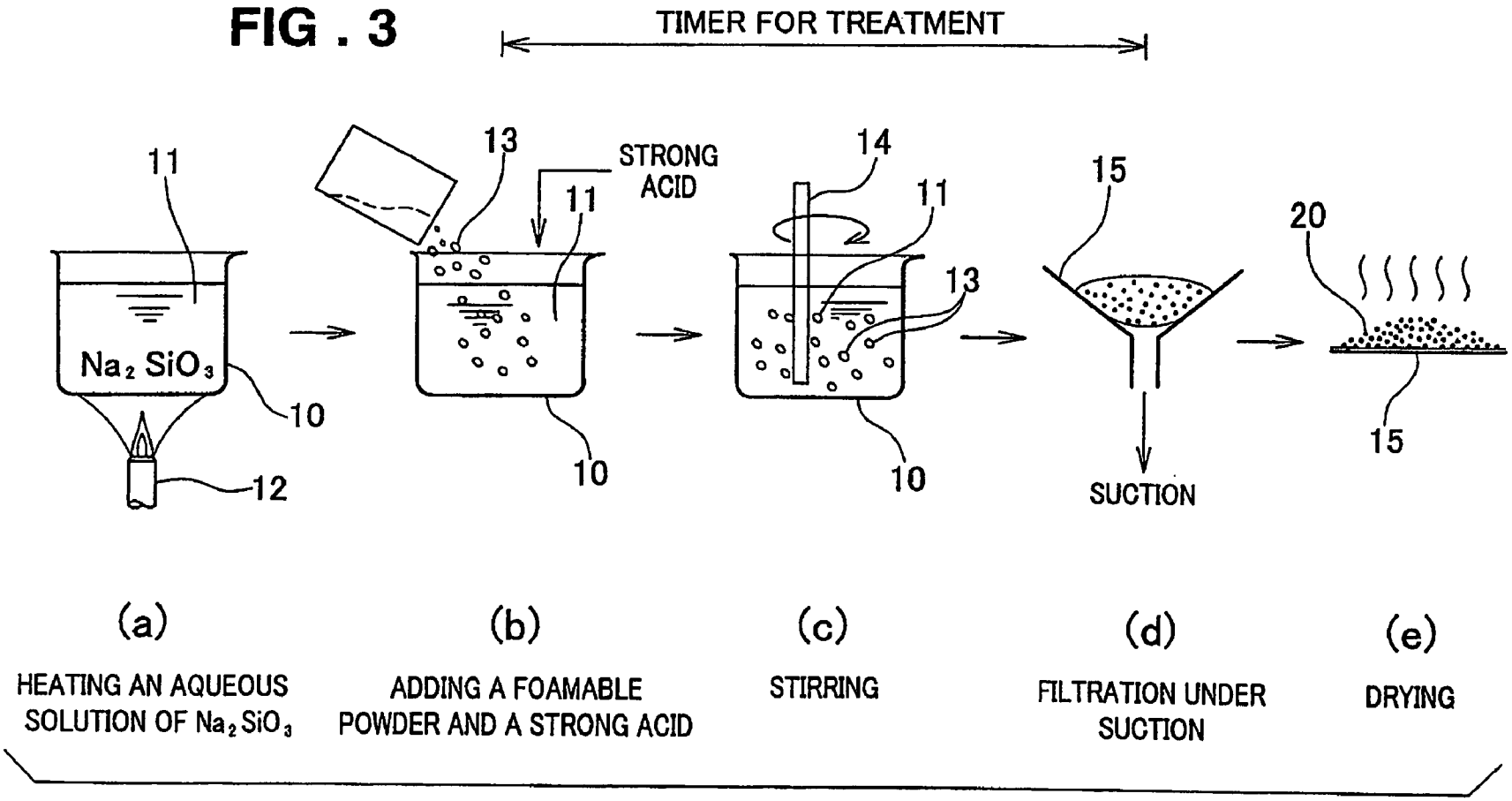
FIG. 3 is a flowchart showing a process for manufacturing a foaming agent according to this invention by co-precipitation.

Description will now be made of a co-precipitation process for preparing a foaming agent according to this invention with reference to the flow-chart of FIG. 3 showing a series of steps (a) to (e) constituting the process.

(a) An aqueous solution 11 of $Na_2SiO_3$ in a container 10 is heated to about 40° C. by a heater 12.

(b) A strong acid (e.g. hydrochloric acid) is mixed in the aqueous solution 11 of $Na_2SiO_3$ and a foamable powder 13 is put in it. The foamable powder 13 is preferably of a carbonate, such as calcium carbonate ($CaCO_3$) or magnesium carbonate ($MgCO_3$), as it produces carbon dioxide having no danger of explosion. Magnesium carbonate ($MgCO_3$) is easily available and can be prepared by the dehydration, etc. of highly stable basic magnesium carbonate (4 $MgCO_3.Mg(OH_2).5H_2O$).

(c) The aqueous solution 11 of $Na_2SiO_3$, hydrochloric acid (HCl) and foamable powder 13 are thoroughly stirred together by a stirrer 14. The stirring causes the following reaction to take place:

$$Na_2SiO_3(\text{liquid})+2HCl(\text{liquid})\rightarrow 2NaCl(\text{liquid})+SiO_2(\text{solid})+H_2O(\text{liquid})$$

The liquid is an aqueous solution and the solid is a powder or film. $SiO_2$(solid) is formed by the reaction of formation of colloidal silicic acid which occurs when hydrochloric acid (HCl), which is a strong acid, is added to the aqueous solution of $Na_2SiO_3$ to make it weakly acidic. This $SiO_2$(solid) covers the particle surfaces of $CaCO_3$. As $SiO_2$ is very likely to occur in the form of a silica gel ($SiO_2.nH_2O$), $SiO_2$ forming a coating layer of $SiO_2$ according to this invention includes a silica gel.

(d) The mixed solution is filtered by a filtering material 15, such as filter paper. The filtering work is promoted by suction.

(e) The filtrate is dried to yield a desired foaming agent 20.

Figure 4:
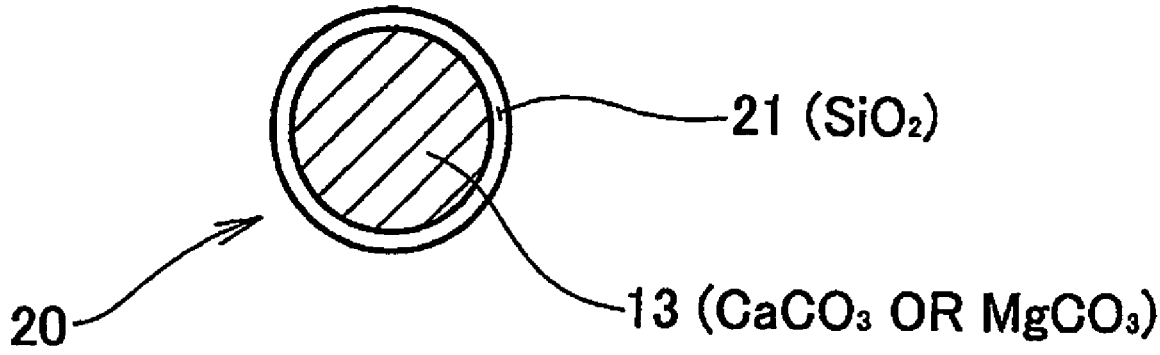
FIG. 4 is a diagrammatic illustration of a particle of the foaming agent according to this invention.

FIG. 4 is a schematic illustration of a particle of the foaming agent according to this invention. The foaming agent 20 is composed of a particle 13 of a foamable powder of $CaCO_3$ or $MgCO_3$ and a coating layer 21 of $SiO_2$ covering the surface of the particle 13.

Figure 5:
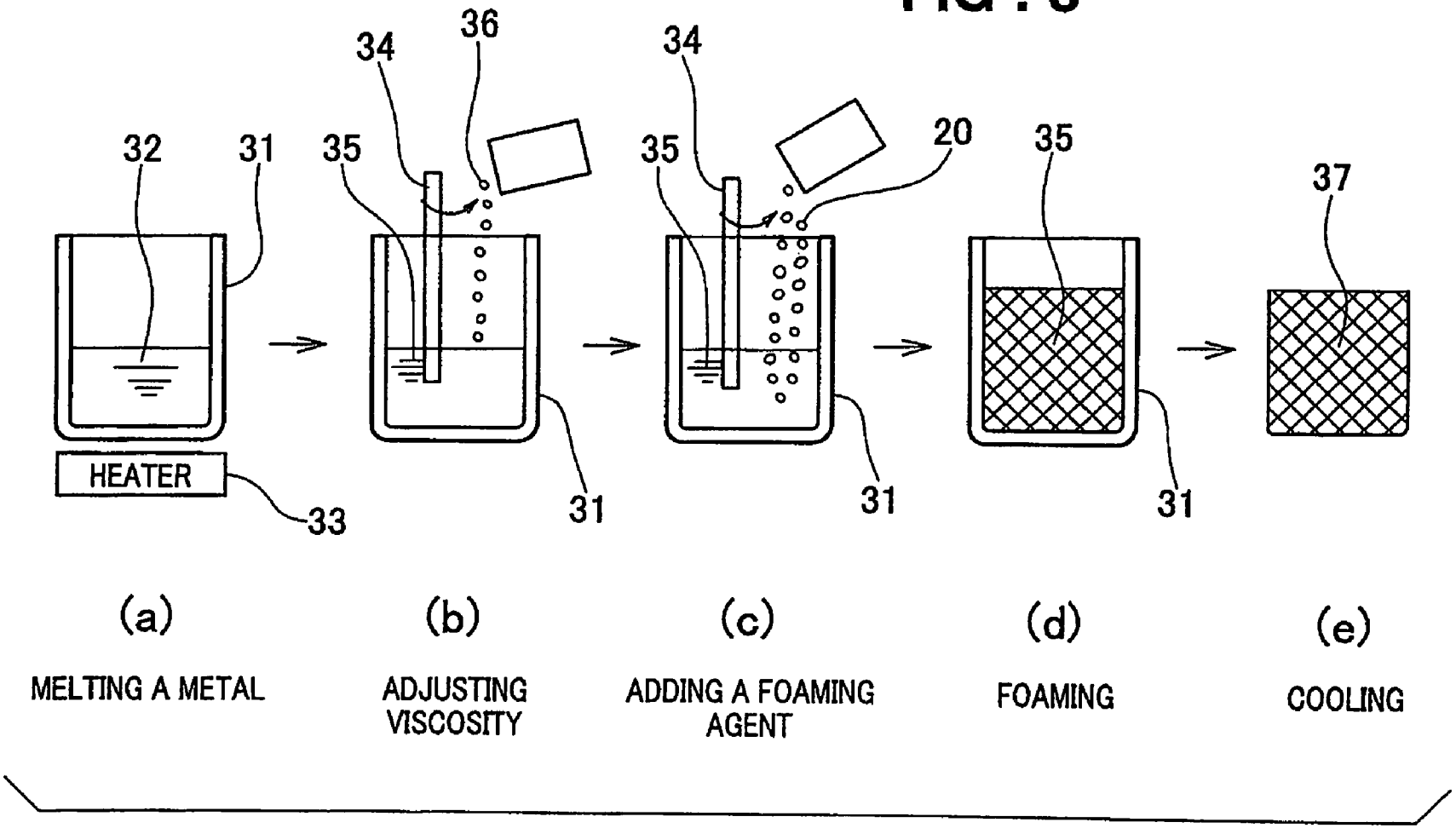
FIG. 5 is a flowchart showing a process for manufacturing a foamed or porous metal by using the foaming agent according to this invention.

Description will now be made of a process for manufacturing a foamed or porous metal by using the foaming agent 20 described above. FIG. 5 shows a series of steps (a) to (e) of the process.

(a) A silicon-aluminum alloy 32 containing 7% of silicon is melted in a crucible 31 by heating to about 700° C. by a heater 33. When vacuum melting is employed, this and subsequent steps are carried out in a vacuum furnace, though no vacuum furnace is shown or described.

(b) A viscosity adjusting agent 36, such as Ca or Mg, is put in the molten alloy 35 to adjust its viscosity, while the molten alloy 35 is stirred by a stirrer 34.

(c) An adequate amount of foaming agent 20 is put in the molten alloy 35.

(d) The gasified foaming agent 20 increases the volume of the molten alloy 35. Its cooling is started.

(e) When it has been cooled to an adequate temperature, the alloy is removed from the crucible and cooled to a further extent to yield a foamed or porous metal 37.

Figure 6:
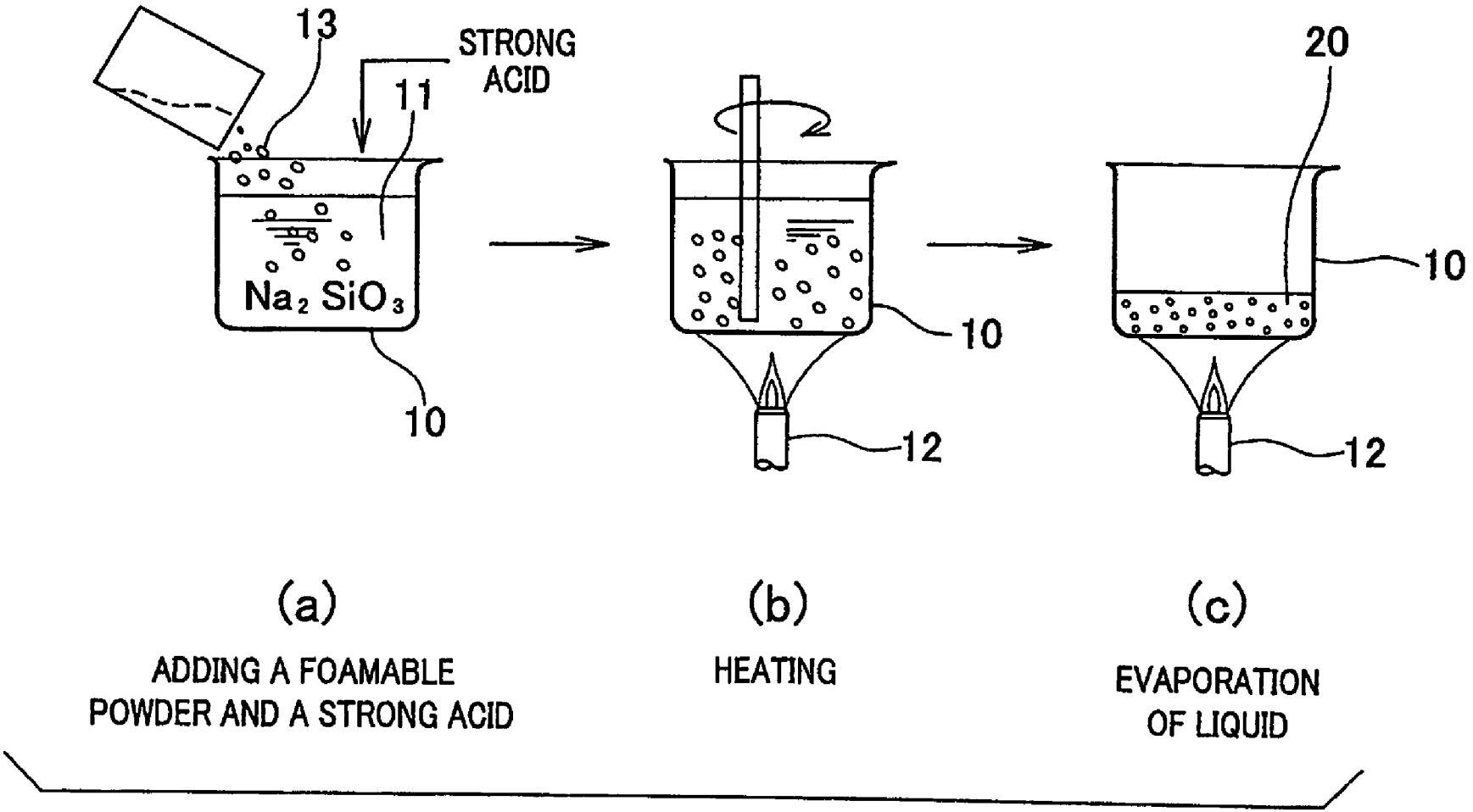
FIG. 6 is a flowchart showing a process for manufacturing a foaming agent according to this invention by evaporation.

Although the co-precipitation process shown in FIG. 3 has been described for the preparation of the foaming agent according to this invention, the foaming agent according to this invention can be prepared by an evaporation process, too. Attention is, therefore, directed to FIG. 6 showing the evaporation process.

(a) A strong acid and a foamable powder 13 are put in an aqueous solution 11 of $Na_2SiO_3$ in a vessel 10.

(b) The aqueous solution 11 of $Na_2SiO_3$, strong acid and foamable powder 13 are stirred together, while the vessel 10 is heated by a heater 12. The stirring causes the following reaction to take place:

$$Na_2SiO_3(\text{liquid})+2HCl(\text{liquid})\rightarrow 2NaCl(\text{liquid})+SiO_2(\text{solid})+H_2O(\text{liquid})$$

The reaction has already been described and no repeated description is, therefore, made.

(c) The heating of the vessel 10 by the heater 12 is continued to evaporate water and eventually yield a foaming agent 20. Each particle of the foaming agent 20 has a cross sectional structure as described before with reference to FIG. 4.

Although an aluminum alloy is, as a principle, used to make a foamed or porous metal (or alloy), it is, of course, possible to use any other metal or alloy, such as a magnesium alloy, an iron alloy or stainless steel. Although the foamable powder is preferably of a carbonate, it is also possible to use any other material that is usually employed for a foaming agent. Although hydrochloric acid has been used as a strong acid, it is also possible to employ any other strong acid, such as sulfuric or nitric acid.

EXAMPLES

The invention will now be described more specifically with reference to experimental examples, though the following description is not intended for limiting the scope of this invention.

A. Conditions for Preparation of a Foaming Agent

Process: Co-precipitation $Na_2SiO_3$ (liquid): 2.0% by mass $CaCO_3$ (solid)/$Na_2SiO_3$ (liquid)=0.21 g/g pH: 6.87

Drying temperature: 100° C.

B. Conditions for Manufacture of a Foamed Metal

Metal to be melted: A silicon-aluminum alloy containing 7% of silicon

Melting apparatus: A vacuum melting furnace

Melting temperature: 700° C.

Viscosity adjusting agent: Ca and Mg

Figure 7:
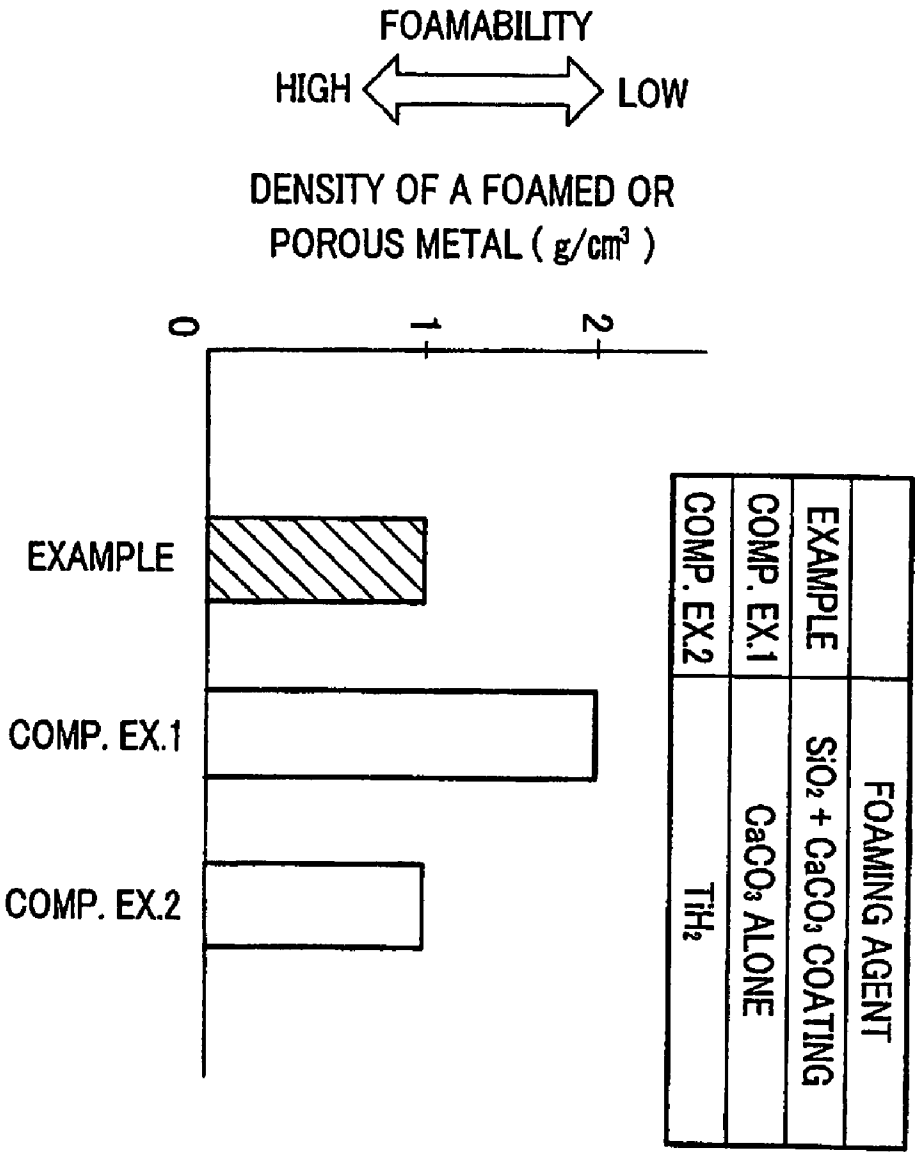
FIG. 7 is a graph showing the density of foamed or porous metals obtained by using different foaming agents.

FIG. 7 is a graph showing the density of the foamed or porous metals obtained in accordance with the Example employing the foaming agent of this invention, as well as Comparative Examples. The product obtained by employing the foaming agent composed of $CaCO_3$ and a coating layer of $SiO_2$ according to this invention showed a density of about 1.0 g/cm$^3$. On the other hand, the product according to Comparative Example 1, which had been made by employing a foaming agent composed of $CaCO_3$ alone, showed a density of about 1.8 g/cm$^3$ and the product according to Comparative Example 2, which had been made by employing an old foaming agent composed of $TiH_2$, showed a density of about 1.0 g/cm$^3$. A lower density means a higher degree of foaming, as shown by an arrow beside the graph in FIG. 7. As is obvious therefrom, the product obtained by employing the foaming agent according to this invention was by far lower in density and higher in foaming degree than that according to Comparative Example 1, and was comparable to the product according to Comparative Example 2.

Obviously various minor changes and modifications of the present invention are possible in the light of the above teaching. It is therefore to be understood that within the scope of the appended claims the invention may be practiced otherwise than as specifically described.

What is claimed is:

1. A combination used for manufacturing a foamed or porous metal, the combination comprising:

a foaming agent including a foamable powder;

a coating layer of $SiO_2$ covering particle surfaces of the powder; and molten aluminum.

2. The combination according to claim 1, wherein the powder is of a carbonate.

3. The combination according to claim 2, wherein the carbonate is $GaCO_3$ or $MgCO_3$.

4. The combination according to claim 2, wherein the carbonate is $MgCO_3$.

5. A method of manufacturing a foamed or porous metal, the method comprising:

preparing a foamable powder having a coating layer of $SiO_2$ covering particle surfaces of the foamable powder;

adding the foamable powder as a foaming agent into a molten metal, wherein heat from the molten metal gasifies the foamable powder; and cooling the molten metal to yield the foamed or porous metal, wherein the foamed or porous metal includes a plurality of pores formed from gasification of the particles of the foamable powder.

6. The method according to claim 5, wherein the powder is of a carbonate.

7. The method according to claim 6, wherein the carbonate is $CaCO_3$ or $MgCO_3$.

8. The method according to claim 6, wherein the carbonate is $MgCO_3$.

9. The method according to claim 5, wherein the molten metal is molten aluminum.

10. The combination according to claim 1, wherein the coating layer of $SiO_2$ is a uniform coating layer.

11. The combination according to claim 1, wherein the coating layer consists essentially of $SiO_2$.

12. The combination according to claim 1, wherein the coating layer is in the form of a silica gel of $SiO_2.nH_2O$.

* * * * *